US010714300B2

(12) United States Patent
Heinke et al.

(10) Patent No.: US 10,714,300 B2
(45) Date of Patent: Jul. 14, 2020

(54) STATIONARY ANODE FOR AN X-RAY GENERATOR, AND X-RAY GENERATOR

(71) Applicant: Siemens Healthcare GmbH, Erlangen (DE)

(72) Inventors: Tobias Heinke, Rudolstadt (DE); Michael Langguth, Wipfratal (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 16/140,707

(22) Filed: Sep. 25, 2018

(65) Prior Publication Data

US 2019/0096625 A1 Mar. 28, 2019

(30) Foreign Application Priority Data

Sep. 27, 2017 (DE) ..... 10 2017 217 181

(51) Int. Cl.

| | |
|---|---|
| ***H01J 35/12*** | (2006.01) |
| ***H05G 1/02*** | (2006.01) |
| ***H05G 1/36*** | (2006.01) |
| ***H05G 1/64*** | (2006.01) |

(52) U.S. Cl.

CPC ..... *H01J 35/12* (2013.01); *H05G 1/025* (2013.01); *H05G 1/36* (2013.01); *H05G 1/64* (2013.01); *H01J 2235/1262* (2013.01)

(58) Field of Classification Search

CPC ..... H01J 35/12; H01J 35/16; H01J 35/165; H01J 2235/1204; H01J 2235/1262; H05G 1/025; H05G 1/36; H05G 1/64

See application file for complete search history.

(56) References Cited

U.S. PATENT DOCUMENTS

| | | | | |
|---|---|---|---|---|
| 2,790,102 A * | 4/1957 | Atlee | ..... | H01J 35/12 313/32 |
| 3,914,633 A * | 10/1975 | Diemer | ..... | H01J 35/12 378/143 |
| 4,064,411 A * | 12/1977 | Iwasaki | ..... | H01J 35/12 378/141 |

(Continued)

FOREIGN PATENT DOCUMENTS

| | | |
|---|---|---|
| CH | 663114 A5 | 11/1987 |
| DE | 9105292 U1 | 9/1991 |

OTHER PUBLICATIONS

German Office Action for German Application No. 10-2017217-181.2 dated Apr. 26, 2018.

(Continued)

*Primary Examiner* — David J Makiya
*Assistant Examiner* — Soorena Kefayati
(74) *Attorney, Agent, or Firm* — Harness, Dickey & Pierce, P.L.C.

(57) ABSTRACT

A stationary anode for an X-ray generator, in particular of an X-ray imaging device or an X-ray therapy or spectroscopy device, includes a main anode body and an internal cooling duct, running in the axial direction, for conveying a cooling fluid to a heat exchange surface of the main anode body. A nozzle, disposed at the end of the cooling duct, is inventively positioned with respect to the heat exchange surface via stop elements such that, between the heat exchange surface and the nozzle, a gap is formed which extends over an angular range of 360° about the axial direction.

18 Claims, 3 Drawing Sheets

(56) References Cited

U.S. PATENT DOCUMENTS 4,258,262 A * 3/1981 Maldonado ..... H01J 35/12 378/141
4,264,818 A * 4/1981 Petersen ..... H01J 35/12 378/141
4,455,504 A * 6/1984 Iversen ..... H01J 35/106 313/30
4,521,903 A * 6/1985 Braun ..... H01J 35/12 378/141
4,618,972 A * 10/1986 Georgiou ..... H01J 35/12 378/141
4,644,217 A * 2/1987 Hoet ..... H01J 19/74 313/35
4,685,119 A * 8/1987 Bird ..... H01J 35/106 378/127
4,969,173 A * 11/1990 Valkonet ..... H01J 35/06 378/136
5,052,034 A * 9/1991 Schuster ..... H01J 35/08 378/121
5,204,890 A * 4/1993 Anno ..... H01J 35/101 378/133
5,416,820 A * 5/1995 Weil ..... H01J 35/106 378/127
5,535,255 A * 7/1996 Gabbay ..... H01J 35/12 378/141
6,002,745 A * 12/1999 Miller ..... H01J 35/101 378/128
6,192,107 B1 * 2/2001 Price ..... H01J 35/106 378/125
6,252,934 B1 * 6/2001 Scott ..... H01J 35/106 165/164
6,519,318 B1 * 2/2003 Andrews ..... H01J 35/12 378/119
6,580,780 B1 * 6/2003 Miller ..... H01J 35/12 378/130
7,158,612 B2 * 1/2007 Rusch ..... H01J 35/08 378/121
9,001,973 B2 * 4/2015 Morton ..... G21K 1/02 378/124
2002/0097838 A1 * 7/2002 Saito ..... F16C 37/002 378/130
2006/0171506 A1 * 8/2006 Lovoi ..... A61N 5/1002 378/130
2007/0086574 A1 * 4/2007 Lenz ..... H01J 35/105 378/143
2008/0019485 A1 * 1/2008 Weiss ..... B82Y 30/00 378/199
2008/0043921 A1 * 2/2008 Freudenberger ..... H01J 35/105 378/144
2014/0314197 A1 * 10/2014 Watanabe ..... H01J 35/12 378/4
2015/0325400 A1 * 11/2015 Hans ..... H01J 35/12 378/142
2018/0221830 A1 * 8/2018 Larson ..... H01J 5/18
2018/0376574 A1 * 12/2018 Rogers ..... H01J 35/065

OTHER PUBLICATIONS

German Office Action and English translation thereof dated Apr. 26, 2018.
German Decision to Grant and English translation thereof dated Jun. 28, 2018.
Office Action for Chinese Patent Application No. 201811123645.9 dated Oct. 9, 2019.
Office Action for Chinese Patent Application No. 201811123645.9 dated Oct. 9, 2019 and English translation thereof.

* cited by examiner

B-B

STATIONARY ANODE FOR AN X-RAY GENERATOR, AND X-RAY GENERATOR

PRIORITY STATEMENT

The present application hereby claims priority under 35 U.S.C. § 119 to German patent application number DE 102017217181.2 filed Sep. 27, 2017, the entire contents of which are hereby incorporated herein by reference.

FIELD

At least one embodiment of the invention generally relates to a stationary anode for an X-ray generator, in particular of an X-ray imaging device or an X-ray therapy or spectroscopy device, comprising a main anode body and an internal cooling duct running in the axial direction for conveying a cooling fluid to a heat exchange surface of the main anode body. At least one embodiment of the invention further relates to an X-ray generator having a stationary anode implemented in this manner.

BACKGROUND

X-ray generators (also known as X-ray tubes) having stationary anodes, i.e. anodes that are immovably and in particular non-rotatably mounted in a vacuum enclosure of the X-ray generator, are known from various fields of X-ray technology, in particular the fields of imaging, radiation therapy or spectroscopy. In order to obtain correspondingly high performance, it is sometimes necessary to actively pass a cooling fluid through stationary anodes. Known stationary anodes have cooling ducts to carry the cooling fluid and are disposed such that in particular cooling fluid can be applied to an underside of a main anode body. The target which is able to be bombarded with electrons to produce X-radiation is typically disposed on the opposite upper side of the main anode body.

During operation, the target and the main anode body connected to the target material are at positive high voltage potential. Therefore, only coolants having little or no electrically conductivity tend to be used as cooling fluids. A cooling fluid used in practice is e.g. demineralized water (DM water). However, DM water has the property of binding ions from the environment. If the ion-enriched DM water comes into contact with in particular a main anode body consisting of copper, corrosion and progressive destruction and wash-out of the material will occur. This process is generally intensified by high temperatures and flow rates of the cooling fluid. For this reason, the surfaces coming into contact with the DM water, particularly heat exchange surfaces which are used to transfer heat to the cooling fluid flowing through the stationary anode, are often provided with a thin coating, i.e. a protective layer. However, the coating can be easily damaged in the event of mechanical stress particularly during assembly.

X-ray generators in which nozzles for cooling fluid are disposed at a distance from a main anode body over the entire circumference via stop elements are disclosed in U.S. Pat. Nos. 4,064,411 or 3,914,633, for example.

CH 663 114 describes a bottom-cooled anode body wherein an internal cooling chamber is delimited by an internal, conically shaped end face such that the axial width of the internal cooling chamber continuously decreases from the center to the edge in the radial direction.

SUMMARY

At least one embodiment of the present invention specifies an improved stationary anode in respect of thermal coupling to the cooling fluid.

Advantageous embodiments are set forth in the respective claims.

A stationary anode for an X-ray generator, in particular of an X-ray imaging device or an X-ray therapy or spectroscopy device, comprises a main anode body and an internal cooling duct running in the axial direction for conveying a cooling fluid to a heat exchange surface of the main anode body. A nozzle disposed at the end of the cooling duct is positioned with respect to the heat exchange surface via stop elements such that a gap extending over an angular range of 360° about the axial direction is formed between the heat exchange surface and the nozzle.

An X-ray generator, in particular of an X-ray imaging device or an X-ray therapy or spectroscopy device, comprises, according to at least one embodiment of the present invention, the electron-bombardable stationary anode of at least one embodiment described, having a main anode body and an internal cooling duct running in the axial direction for conveying a cooling fluid to a heat exchange surface of the main anode body. A nozzle disposed at the end of the cooling duct is positioned in relation to the heat exchange surface via stop elements such that a gap between the heat exchange surface and nozzle is formed which extends completely over an angular range of 360° about the axial direction.

According to at least one embodiment of the invention, a central region of the heat exchange surface, in particular a region of the heat exchange surface centered about the axial direction, is conically shaped. A funnel-shaped outlet orifice of the nozzle is disposed opposite the conically shaped central region of the heat exchange surface.

BRIEF DESCRIPTION OF THE DRAWINGS

The described characteristics, features and advantages of embodiments of the invention and the way in which they are achieved will become clearer and more readily understandable in conjunction with the following description of the example embodiments which will be explained in greater detail with reference to the accompanying drawings.

For further description of embodiments of the invention, reference is made to the examples schematically illustrated in the figures in which.

Mutually corresponding parts are provided with the same reference characters in the figures.

DETAILED DESCRIPTION OF THE EXAMPLE EMBODIMENTS

Figure 1:
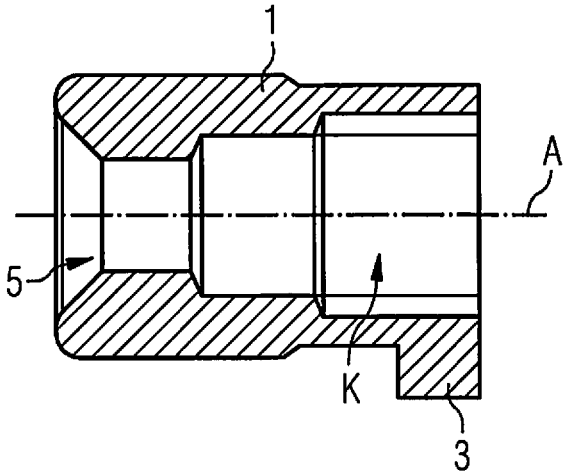
FIG. 1: shows a cross-sectional view of a nozzle for a stationary anode.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

A stationary anode for an X-ray generator, in particular of an X-ray imaging device or an X-ray therapy or spectroscopy device, comprises a main anode body and an internal cooling duct running in the axial direction for conveying a cooling fluid to a heat exchange surface of the main anode body. A nozzle disposed at the end of the cooling duct is positioned with respect to the heat exchange surface via stop elements such that a gap extending over an angular range of 360° about the axial direction is formed between the heat exchange surface and the nozzle.

On the one hand, it is therefore proposed to provide a nozzle at the end of the cooling duct in order to bring about an increase in the flow rate of the cooling fluid around the heat exchange surface. On the other hand, the distance of the nozzle from the heat exchange surface of the main anode body is set in a defined manner via stop elements so that a gap is formed between the nozzle and the heat exchange surface over the entire angular range of 360° about the axial direction. In other words, the nozzle does not rest against the heat exchange surface at any point. The stop elements are disposed at a location not subject to thermal stress which is in particular at an axial distance from the heat exchange surface. Such a design is advantageous, as the effective size of the available area of solid objects in direct contact with the heat exchange surface for heat transfer is reduced.

Moreover, such contact can cause local hot spots which can in turn result in thermal stress in the main anode material. This is particularly important for heavy-duty stationary anodes, as it generally limits the achievable performance. A homogeneous heat distribution is therefore desirable.

Even if higher performance is not the aim, an additional safety margin in respect of current operating scenarios is provided, so that the useful life of the stationary anode is increased. The stop elements also ensure that the nozzle cannot normally come into contact with the heat exchange surface even during assembly. The risk of damaging the heat exchange surface during assembly is therefore at least reduced.

The physical implementation of the stationary anode in the region of the heat exchange surface means that no or only a few local hot spots occur in the temperature-critical range during operation. The heat exchange surface can have cooling fluid applied to it evenly and rotation-symmetrically throughout the 360° angular range. This results in uniform and defined flow conditions.

The relatively simple design of the stationary anode, in particular of the nozzle and associated stop elements, enables it to be produced using conventional manufacturing techniques such as turning or milling, for example. As a result, a high degree of manufacturing precision and/or reproducibility can be achieved in terms of the geometry and positional tolerances of the components with respect to one another, in particular of the nozzle with respect to the heat exchange surface.

According to at least one embodiment of the invention, a central region of the heat exchange surface, in particular a region of the heat exchange surface centered about the axial direction, is conically shaped. The conically shaped and in particular protruding central region of the heat exchange surface is used primarily to increase the area available for heat transfer to the cooling fluid. A funnel-shaped outlet orifice of the nozzle is disposed opposite the conically shaped central region of the heat exchange surface. In other words, the nozzle and the heat exchange surface are complementary in respect of shape and flow. As a result, particularly high flow rates can be achieved in the region of the conical protrusion, thereby additionally improving heat dissipation.

In possible example embodiments, the stationary anode is essentially, i.e. at least approximately, of axially symmetric design. The term axial direction refers in particular to the direction along the axis of symmetry. A direction perpendicular thereto is termed in particular the radial direction.

The cooling fluid is in particular a coolant in the liquid state. For example, the cooling fluid is a cooling oil or the demineralized water (DM water) already mentioned in the introduction. The cooling fluid has in particular an at least reduced electrical conductivity.

In possible example embodiments, the cooling duct is formed at least in sections by a supply tube which extends in the axial direction inside the main anode body. The cooling duct in particular extends on through the nozzle in the axial direction.

In a preferred example embodiment, the cooling duct, in particular the supply tube, runs concentrically to the axial direction inside the main anode body. In a radial direction running perpendicular to the axial direction, the supply tube is in particular disposed at a distance from a sleeve-like section of the main anode body which extends from the heat exchange surface in the axial direction. The gap between the sleeve-like section of the main anode body and the supply tube is used for the return flow of the cooling fluid.

In an embodiment, it is provided to implement the stop elements as radially projecting ridges which are disposed on an end of the nozzle remote from the heat exchange surface and abutting an internal and in particular circumferential shoulder of the main anode body. The ridges are in contact with the main anode body via the inner shoulder at a thermally unstressed location which is in particular disposed at a distance from the heat exchange point in the axial direction. The inner shoulder is in particular mounted on an inner surface of the sleeve-shaped section of the main anode body extending from the heat exchange surface in the axial direction and runs circumferentially about the axial direction. In other words, direct contact between the nozzle and the highly thermally stressed heat exchange surface (also: cooling base) is prevented, as the corresponding contact surface between these components is disposed in thermally non-critical areas of the main anode body or rather of the anode head.

The ridges are preferably disposed in an offset manner at regular angular distances circumferentially about the axial direction. In a possible example embodiment of the invention, the ridges are disposed at angular spacings of 120° about the axial direction and are in contact with a circumferential inner shoulder of the main anode body. The physical implementation of these stop elements is used in particular to center the nozzle with respect to the heat exchange surface or cooling base such that the nozzle orifice runs concentrically to the axial direction and so that the cooling fluid supplied flows evenly around the heat exchange surface.

The cooling duct preferably narrows in the region of the nozzle so that higher flow rates and therefore an improved heat exchange can be ensured.

In the embodiment, a plurality of cooling duct sections extending at least in sections in the radial direction are incorporated in the main anode body. In this example embodiment, the main anode body is implemented, in particular in the region of the heat exchange surface, such that cooling fluid can flow through it in order to improve the heat transfer still further. Said cooling duct sections can be closed or open to the heat exchange surface, e.g. as groove-like recesses.

In a preferred example embodiment, the cooling duct sections provided in the main anode body are of spiral-shaped design in order to improve still further the thermal coupling to the through-flowing cooling fluid.

Preferably at least one region of the main anode body, in particular a region of the anode heat sink encompassing the cooling duct sections, is formed by an additive manufacturing process, in particular via 3D metal printing, laser sintering or selective laser melting.

The heat exchange surface is preferably coated, at least in areas, with a material that is corrosion-resistant in respect of the cooling fluid. This reduces wear affecting the main anode material. Mechanical stress on the coating during assembly of the stationary anode is at least reduced, as direct contact can be prevented by the stop elements. Even in the event of incorrect fitting, mechanical contact is prevented generally because of the shaping of the stop elements, as these are designed according to the error-preventing "poka-yoke" principle. This enables particularly thin coatings to be used which advantageously have minimal adverse effect on thermal conduction between main anode body and cooling fluid.

The coating preferably consists of a metal, in particular nickel or gold.

The main anode body is preferably connected in a thermally conductive manner to a target made of target material, in particular of tungsten, rhodium, molybdenum or gold. The target can be bombarded with electrons to produce X-rays and is, for example, embedded in the main anode body which is thus used as a substrate having good thermal conductivity.

The main anode body is preferably made of a main anode material, particularly copper.

An X-ray generator, in particular of an X-ray imaging device or an X-ray therapy or spectroscopy device, comprises, according to at least one embodiment of the present invention, the electron-bombardable stationary anode of at least one embodiment described, having a main anode body and an internal cooling duct running in the axial direction for conveying a cooling fluid to a heat exchange surface of the main anode body. A nozzle disposed at the end of the cooling duct is positioned in relation to the heat exchange surface via stop elements such that a gap between the heat exchange surface and nozzle is formed which extends completely over an angular range of 360° about the axial direction.

According to at least one embodiment of the invention, a central region of the heat exchange surface, in particular a region of the heat exchange surface centered about the axial direction, is conically shaped. A funnel-shaped outlet orifice of the nozzle is disposed opposite the conically shaped central region of the heat exchange surface.

The described stationary anode and/or the above described X-ray generator are preferably used in an X-ray device for radiation therapy or spectroscopy. Other fields of application relate to medical or industrial X-ray imaging equipment, e.g. for inspecting freight, particularly freight containers.

Figure 2:
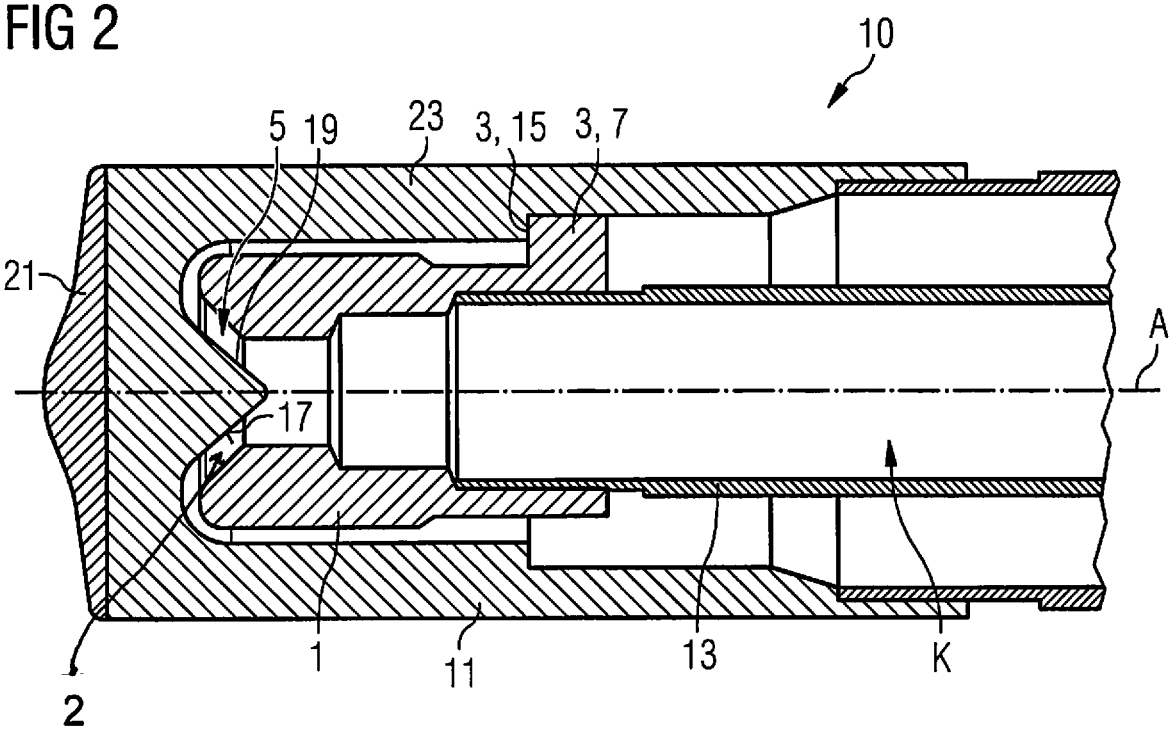
FIG. 2: shows a cross-sectional view of a stationary anode with internal nozzle.

FIG. 1 shows a nozzle 1 for a stationary anode 10 illustrated in detail in FIG. 2.

The nozzle 1 has a cooling duct K which narrows in the axial direction A for supplying cooling fluid, in particular demineralized water, and which ends in a funnel-shaped outlet orifice 5.

Figure 5:
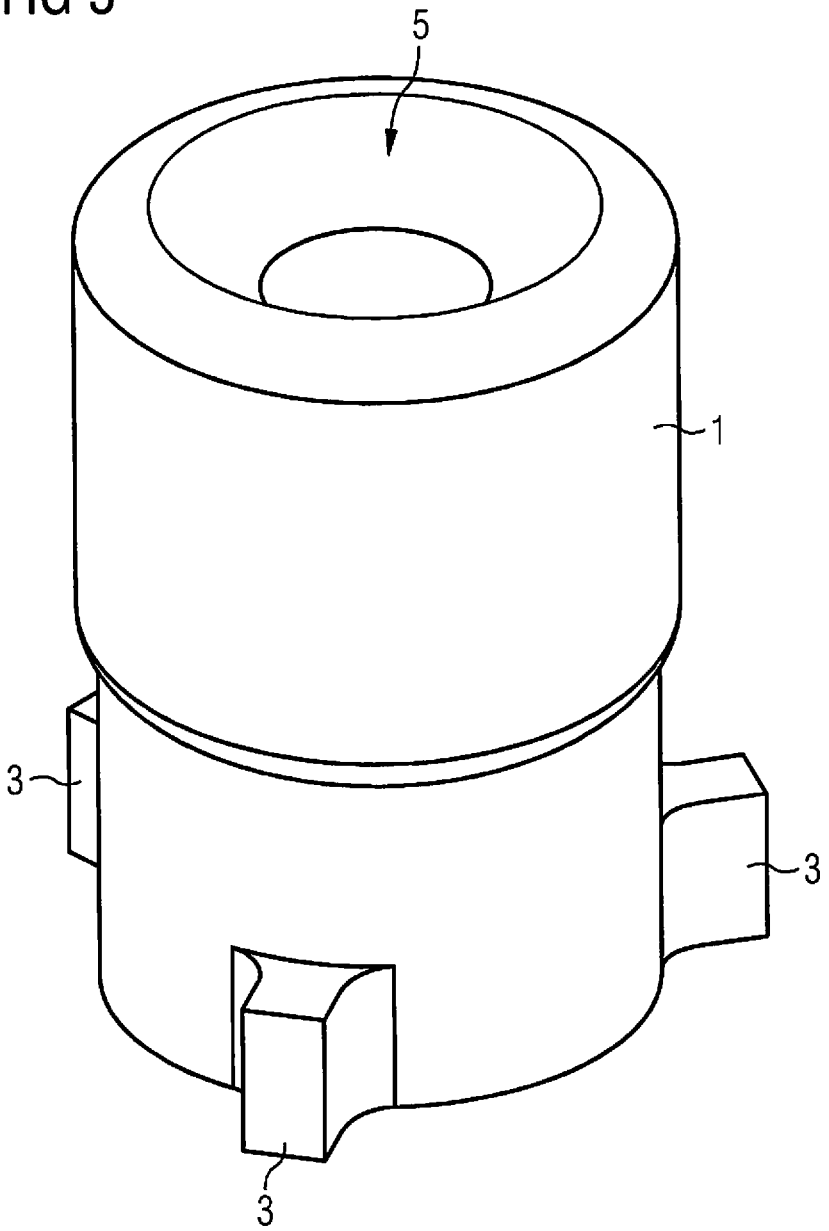
FIG. 5: shows radially projected ridges that are offset at regular intervals about the axial direction.

A nozzle 1 disposed at the end of the cooling duct K is positioned in relation to a heat exchange surface 17 via stop elements such that a gap 2 between the heat exchange surface and nozzle is formed which extends completely over an angular range of 360° about the axial direction. The nozzle additionally has three stop elements 3 implemented as radially projecting ridges 7, only one of which lies in the sectional plane shown in FIG. 1. As shown in FIG. 5, the stop elements 3 implemented as ridges 7 are disposed circumferentially at 120° angular spacings and are used for fixing and centering the nozzle 1 with respect to a main anode body 11 of the stationary anode 10 such that the cooling duct K runs concentrically inside the stationary anode 1. For this purpose the nozzle 1 is connected, at an end facing away from the outlet orifice 5, to a supply tube 13 defining the cooling duct K section by section.

The ridges 7 implemented as stop elements 3 rest against an inner shoulder 15 of the main anode body 11 in a form-fit manner both in the radial direction and in the axial direction A. The ridges 7 and the shoulder 15 are designed such that during installation the nozzle 1 can be simply inserted into the main anode carrier 11, wherein the stop elements 3 ensure that the end of the nozzle 1 having the outlet orifice 5 is disposed at a distance from an internal heat exchange surface 17 with respect to the axial direction. The heat exchange surface 17 is conically shaped in the central region 19 near the axis. The conically shaped central region 19 is opposite the outlet orifice 5 and disposed at a distance therefrom, so that cooling fluid flows evenly round the heat exchange surface 17 over the full angular range of 360° even in this region.

The main anode body 11 consists of a material having good thermal conductivity, e.g. copper, and is used as a substrate for a target 21, e.g. of tungsten, rhodium, molybdenum or gold, which can be bombarded with accelerated electrons to generate in particular bremsstrahlung or characteristic X-rays. For this purpose the anode, in particular the target 21 and the main anode body 11, is in per se known manner at positive high voltage potential. During operation of an X-ray generator incorporating the stationary anode 10, the main anode body 11 is used in particular to dissipate heat to the cooling fluid supplied through the cooling duct K. The nozzle 1 mounted at the end of the supply tube 13 directs the cooling fluid stream onto the internal heat exchange surface 17 which is subject to high thermal stress during operation. Regarded as a heat exchange surface 17 is in particular the internal surface of the main anode body 11 which is disposed opposite the target 21 and extends in the radial direction.

The nozzle 1 is fixed or attached at a largely thermally unstressed location of a sleeve-shaped section 23 of the main anode body 11. The stop elements 3 contact the sleeve-shaped section circumferentially enclosing the nozzle 1 in particular at a location which is disposed at a distance from the heat exchange surface 17 in the axial direction R. The shoulder 15 is in particular inserted into a circumferential inner surface of the sleeve-shaped section 23. The stop elements 3 and the shoulder 15 ensure correct centering and positioning of the nozzle 1 in particular with respect to the heat exchange surface 17 whatever the rotational orientation of the nozzle 1 with respect to the axial direction A.

In other example embodiments, the stop elements 3 are shaped in a complementary manner such that the nozzle 1 can be inserted into the main anode body 11 or rather into the cooling base formed by the main anode body 11 only in the correct orientation.

The main anode body 11 is provided on the inside and in particular in the region of the heat exchange surface 17 with a corrosion-resistant coating, e.g. of nickel. The coating is preferably very thin so that good thermal coupling to the cooling fluid is ensured. The coating thickness is preferably a few micrometers (μm), in particular between 5 μm and 50 μm, preferably e.g. 10 μm to 15 μm, with particular preference 12 μm.

The centering a fixing of the nozzle 1 provided by the stop elements 3 takes place so as to enable the fluid to flow freely against in particular the conically shaped region 19 of the heat exchange surface 17. Even during assembly of the stationary anode 1, the nozzle 1 does not come into direct contact with the coated heat exchange surface 17, so that damage can be largely prevented. This also makes it possible to move to very thin coatings in order to improve still further the thermal coupling to the cooling fluid supplied.

Figure 3:
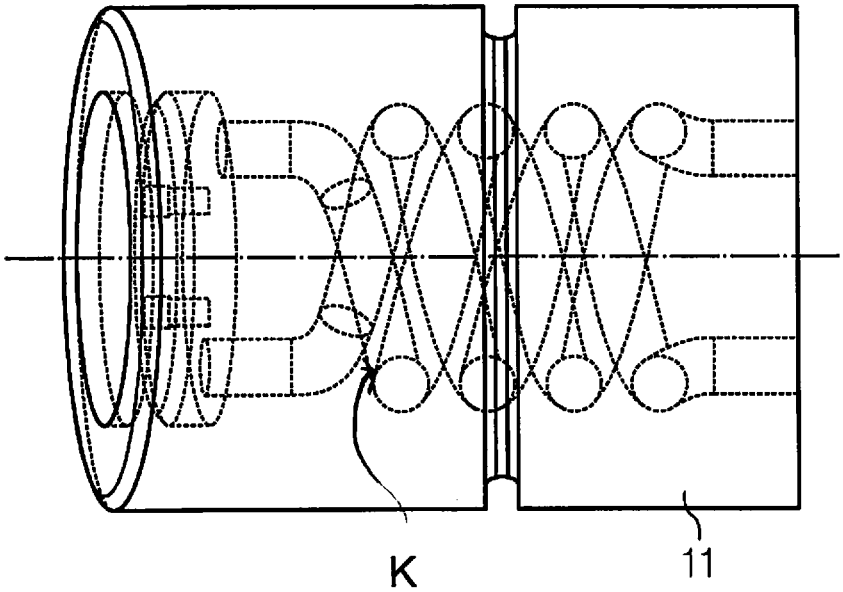
FIG. 3: shows a main anode body having duct sections that are spirally shaped.
Figure 4:
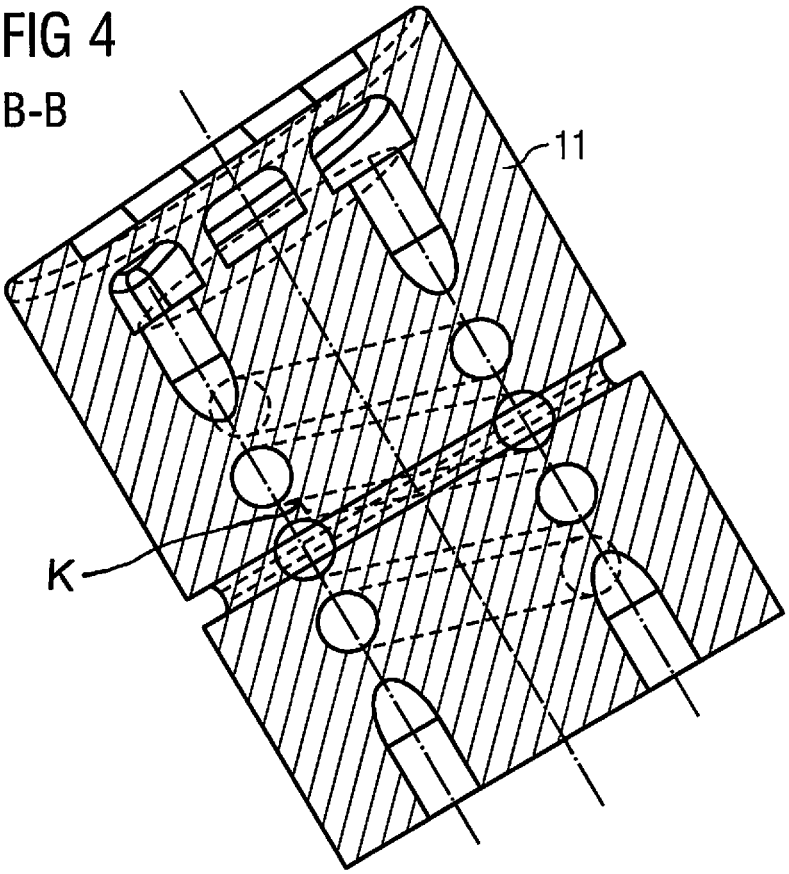
FIG. 4: shows a main anode body having duct sections that are spirally shaped.

In an embodiment shown in FIGS. 3 and 4, the cooling duct sections K are provided in the main anode body 11 and are of spiral-shaped design in order to improve still further the thermal coupling to the through-flowing cooling fluid.

Although the invention has been illustrated and described in detail by the preferred example embodiments, the invention is not limited to the examples disclosed. Other variations will be apparent to persons skilled in the art without departing from the basic concept of the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A stationary anode for an X-ray generator, comprising:

a main anode body; and an internal cooling duct, running in an axial direction, to convey a cooling fluid to a heat exchange surface of the main anode body that is disposed opposite a target, wherein a nozzle, disposed at an end of the internal cooling duct, is positioned with respect to the heat exchange surface via stop elements such that, between the heat exchange surface and the nozzle, a gap is formed extending over an angular range of 360° about the axial direction, a central region of the heat exchange surface being conically shaped and forming a conically shaped region disposed opposite a funnel-shaped outlet orifice of the nozzle, wherein the conically shaped region of the heat exchange surface extends into the funnel-shaped outlet orifice.

2. The stationary anode of claim 1, wherein the internal cooling duct includes a spiral shaped supply tube that runs concentrically inside the stationary anode in the axial direction.

3. The stationary anode of claim 1, wherein the stop elements are implemented as radially projecting ridges, disposed at an end of the nozzle facing away from the heat exchange surface and abutting an inner shoulder of the main anode body.

4. The stationary anode of claim 1, wherein the internal cooling duct relatively narrows in a region of the nozzle.

5. The stationary anode of claim 1, wherein a plurality of cooling duct sections, extending at least in sections in a radial direction, are inserted in the main anode body.

6. The stationary anode of claim 1, wherein at least one region of the main anode body is formed by an additive manufacturing process.

7. The stationary anode of claim 1, wherein the heat exchange surface is coated, at least in areas, with a coating of material that is corrosion resistant with respect to the cooling fluid.

8. The stationary anode of claim 1, wherein the target is an electron-bombardable target made of a target material.

9. The stationary anode of claim 1, wherein the main anode body is made of a material different from a material of the target.

10. An X-ray imaging device, comprising:

an X-ray generator including the stationary anode of claim 1, the stationary anode including a main anode body, and an internal cooling duct, running in an axial direction, to convey a cooling fluid to a heat exchange surface of the main anode body that is disposed opposite a target, wherein a nozzle, disposed at an end of the internal cooling duct, is positioned with respect to the heat exchange surface via stop elements such that, between the heat exchange surface and the nozzle, a gap is formed extending over an angular range of 360° about the axial direction, a central region of the heat exchange surface being conically shaped and forming a conically shaped region disposed opposite a funnel-shaped outlet orifice of the nozzle, wherein the conically shaped region of the heat exchange surface extends into the funnel-shaped outlet orifice.

11. The stationary anode of claim 3, wherein the radially projecting ridges are offset at regular angular intervals circumferentially about the axial direction.

12. The stationary anode of claim 5, wherein the plurality of cooling duct sections are spiral-shaped.

13. The stationary anode of claim 5, wherein a region of the main anode body is an anode heat sink encompassing the plurality of cooling duct sections, is formed by an additive manufacturing process.

14. The stationary anode of claim 6, wherein the additive manufacturing process is 3D metal printing, laser sintering or selective laser melting.

15. The stationary anode of claim 7, wherein the material of the coating is a metal.

16. The stationary anode of claim 8, wherein the target material is tungsten, rhodium, molybdenum or gold.

17. The stationary anode of claim 13, wherein the additive manufacturing process is 3D metal printing, laser sintering or selective laser melting.

18. An X-ray generator, comprising:

an electron-bombardable stationary anode, including a main anode body and an internal cooling duct, running in an axial direction, to convey a cooling fluid to a heat exchange surface of the main anode body that is disposed opposite a target, wherein a nozzle, disposed at an end of the internal cooling duct, is positioned with respect to the heat exchange surface via stop elements such that, between the heat exchange surface and the nozzle, a gap is formed extending over an angular range of 360° about the axial direction, a central region of the heat exchange surface being conically shaped and forming a conically shaped region disposed opposite a funnel-shaped outlet orifice of the nozzle, wherein the conically shaped region of the heat exchange surface extends into the funnel-shaped outlet orifice.

* * * * *